United States Patent [19]

Morohoshi

[11] 4,090,355

[45] May 23, 1978

[54] ELECTRONIC METRONOME

[75] Inventor: Fumio Morohoshi, Tokyo, Japan

[73] Assignee: Kabushiki Kaisha Daini Seikosha, Japan

[21] Appl. No.: 724,315

[22] Filed: Sep. 17, 1976

[30] Foreign Application Priority Data

Sep. 17, 1975 Japan ..... 50-127775[U]

[51] Int. Cl.[2] ..... G04F 5/02; G10B 15/00

[52] U.S. Cl. ..... 58/130 E; 84/484; 340/366 D

[58] Field of Search ..... 58/130 R, 130 A, 130 E; 84/1.03, 464, 484; 340/366 D, 366 R, 378 R, 378

[56] References Cited

U.S. PATENT DOCUMENTS

| | | | |
|---|---|---|---|
| 3,818,693 | 6/1974 | Allard | 58/130 E |
| 3,898,790 | 8/1975 | Takamune et al. | 58/23 BA |
| 3,901,121 | 8/1975 | Kleiner | 84/484 |
| 4,014,167 | 3/1977 | Hasegawa et al. | 84/454 |

*Primary Examiner*—Edith S. Jackmon

*Attorney, Agent, or Firm*—Robert E. Burns; Emmanuel J. Lobato; Bruce L. Adams

[57] ABSTRACT

An electronic metronome has a visual indicator consisting of a package in which a plurality of different light color LED chips are mounted close to each other. Down-beat and up-beat are indicated as different color emissions from a single spot.

3 Claims, 4 Drawing Figures

ELECTRONIC METRONOME

BACKGROUND OF THE INVENTION

This present invention relates to electronic metronomes and more particularly to a metronome having a visual rhythm-displaying device with colours.

Conventional visual tempo-displaying devices display tempos with a single colour of a lamp or other visual indicator, but does not display rhythms.

BRIEF SUMMARY OF THE INVENTION

The principal object of the present invention is to provide an electronic metronome having a visual rhythm-displaying device which is provided with a visual indicator including a pair of light emitting diodes spaced close to and having different light colour from each other, displaying down-beat and up-beat with different colours.

It is another object of this invention to provide a compact and handy electronic metronome with low cost and with long life and good reliability.

DETAILED DESCRIPTION OF THE PREFERRED EMBODIMENTS

Some preferred embodiments of this invention will now be described referring to the attached drawings.

Figure 1:
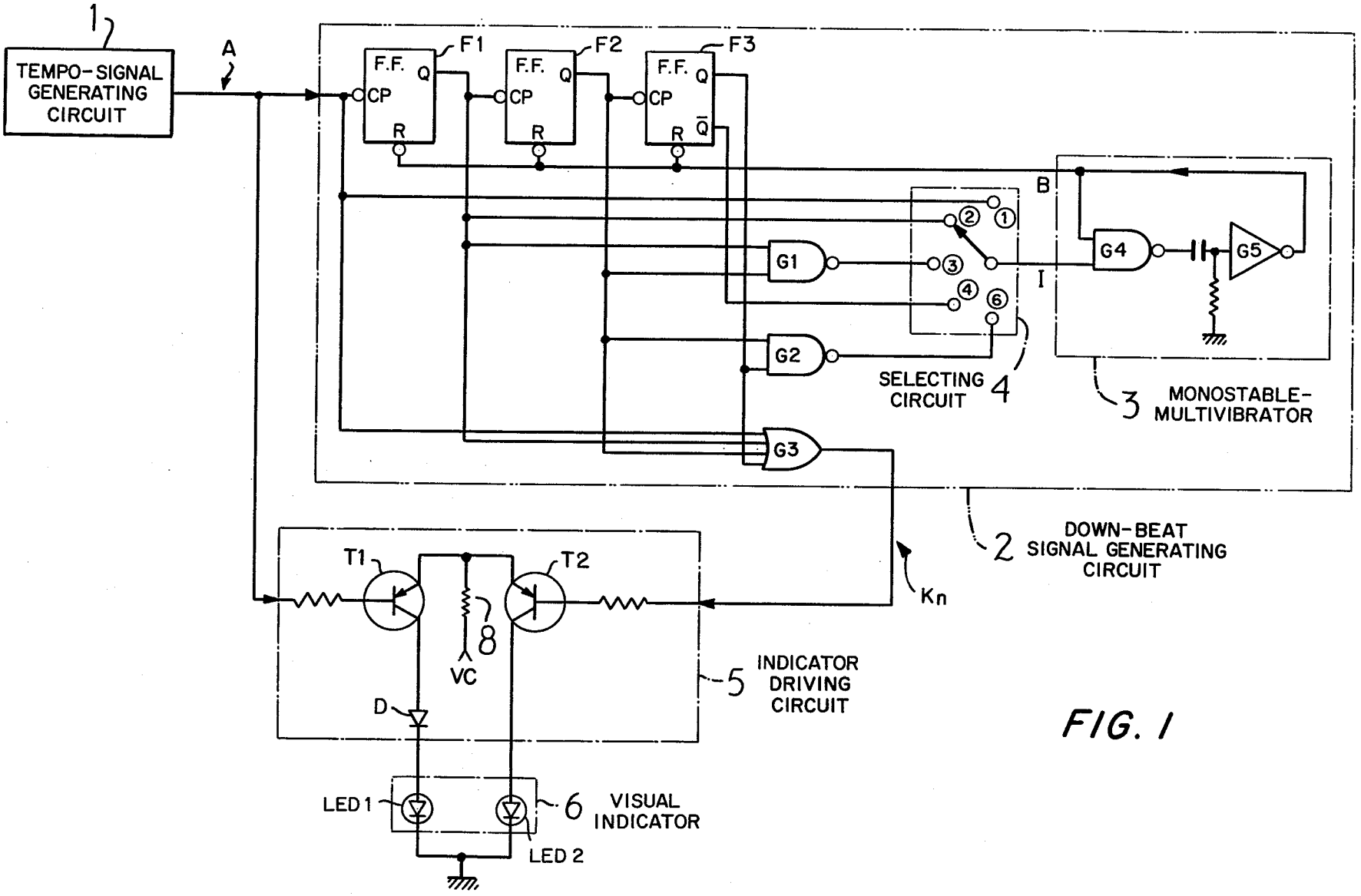
FIG. 1 is a circuit diagram showing an electronic metronome according to the invention.

FIG. 1 is a circuit diagram of an electronic metronome of the invention, in which reference numeral 1 designates a tempo-signal generating circuit which selectively generates pulse signals at a desired tempo A, such as 92 cycles per minute for "moderate."

Reference numeral 2 designates a down-beat signal generating circuit including a set of flip-flops $F_1$, $F_2$ and $F_3$, a pair of NAND gates $G_1$ and $G_2$, a monostable-multivibrator 3, an OR-gate $G_3$ and a selecting switch 4 for time or rhythm selection. Flips-flops $F_1$, $F_2$ and $F_3$ are connected to each other with Q output terminal of flip-flop $F_1$ connected to clock-input terminal CP of flip-flop $F_2$, and Q output terminal of flip-flop $F_2$ connected to clock-input terminal CP of flip-flop $F_3$. The tempo signals of tempo-signal generating circuit 1 are applied to clock-input terminal CP of flip-flop $F_1$ so that the tempo signals are divided into half-cycle signals, quarter-cycle signals and one-eighth cycle signals by flip-flops $F_1$, $F_2$ and $F_3$.

Monostable-multivibrator 3 normally has level "1" at the output B and is changed to have level "0" there when a fall-down signal is applied to the input I of the multivibrator 3, the level "0" forming a short-length negative pulse. The output negative pulse is applied to the reset terminals R of flip-flops $F_1$, $F_2$ and $F_3$ to reset all of them.

A NAND-gate $G_1$ has two inputs, one being connected to output Q of flip-flop $F_1$ and the other connected to output Q of flip-flop $F_2$. Another NAND-gate $G_2$ also has two inputs, one being connected to output Q of flip-flop $F_2$ and the other connected to output Q of flip-flop $F_3$. A selecting switch 4 is provided with switch terminals ①, ②, ③, ④ and ⑥. Terminal ① is connected to the output of tempo-signal generating circuit 1 to transfer tempo signals A to input terminal I of monostable-multivibrator 3. Terminal ② is connected to output Q of flip-flop $F_1$, terminal ③ being connected to the output of NAND-gate $G_1$. Terminal ④ is connected to output $\overline{Q}$ of flip-flop $F_3$ to transfer $\overline{Q}$ signal to input terminal I, terminal ⑥ being connected to the output of NAND-gate $G_2$ to transfer the output signals of gate $G_2$.

To an OR-gate $G_3$ are fed outputs Q of flip-flops $F_1$, $F_2$ and $F_3$ and tempo signals A. Therefore, the output of OR-gate $G_3$ takes level "0" (Kn) only when all the outputs Q of the flip-flops and tempo signal A take level "0". This output Kn is used as a down-beat signal.

Figure 2:
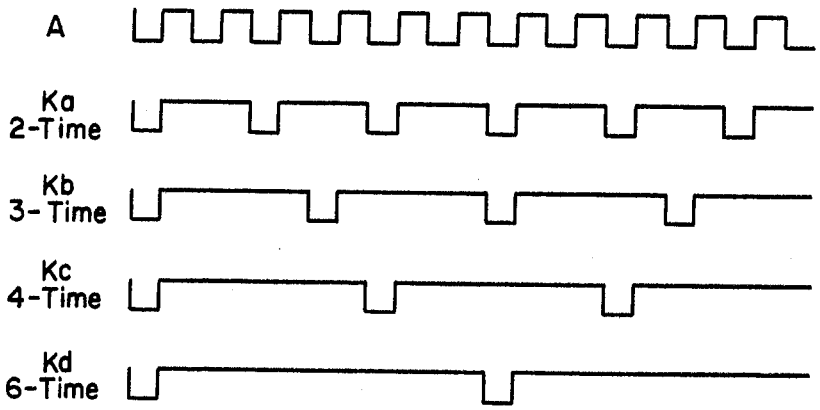
FIG. 2 is a timing graph representing wave forms in the metronome of FIG. 1.

Thus, when switch 4 is connected with terminal ①, down-beat signal K*n* coincides with tempo signal A. When switch 4 is connected with terminal ②, down-beat signal generating circuit 2 operates as a binary counter and a down-beat signal Ka of a negative pulse occurs at every two negative pulses of tempo signal A as shown in FIG. 2. When switch 4 is selected to be connected with ③, ④ or ⑥, down-beat signal generating circuit 2 operates in turn as a divided by three, four or six counter and a down-beat signal K*b*, K*c* or $d_d$ occurs at every three, four or six negative pulses of tempo signal A as shown in FIG. 2.

Figure 3:
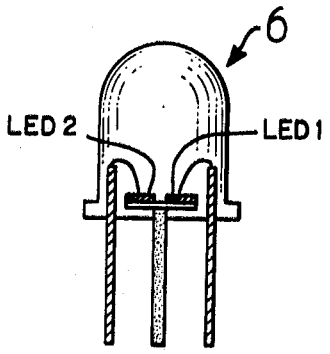
FIG. 3 is a sectional view of the indicator used in the metronome of FIG. 1.

Down-beat signal K*n* is applied to an indicator driving circuit 5 which includes two transistors $T_1$ and $T_2$. The emitters of both the transistors $T_1$ and $T_2$ are connected in common to the power source VC by way of a resistor 8, and the base of transistor $T_1$ receives tempo signals A, the base of transistor $T_2$ receiving down-beat signals K*n*. Reference numeral 6 designates a visual indicator including a pair of light emitting diodes $LED_1$ and $LED_2$ which are, in a state of raw chips, mounted close to each other in a package, as is well shown in FIG. 3, and which have different light colour, such as $LED_1$ has green light and $LED_2$ has red light. So indicator 6 emits, for instance, green or red light from a single point.

$LED_1$ is connected between the collector of transistor $T_1$ by way of a diode D and ground, so that, when tempo signal A takes level 0 (lower level), transistor $T_1$ is made conductive and $LED_1$ emits light. On the contrary, $LED_2$ is connected between the collector of transistor $T_2$ and ground, so that, when down-beat signal K*n* (level "0") is applied to the base of transistor $T_2$, transistor $T_2$ is made conductive and $LED_2$ emits light.

When inputs of level "0" are applied to the bases of both the transistors $T_1$ and $T_2$, emitter potential of transistors $T_1$ and $T_2$ becomes very low because of conductivity of transistor $T_2$ and diode D becomes to effect resistance to current, so that transistor $T_1$ is made nearly non-conductive and $LED_1$ does not emit any light. Thus, $LED_2$ emits light when down-beat signal Kn of level 0 is applied to driving circuit 5 and $LED_1$ emits light with other colour when down-beat signal Kn is made "1" level and tempo signal A of level "0" is applied to driving circuit 5, indicator 6 emitting on and off different colour lights successively at a single point to visually indicate tempo and rhythm.

Figure 4:
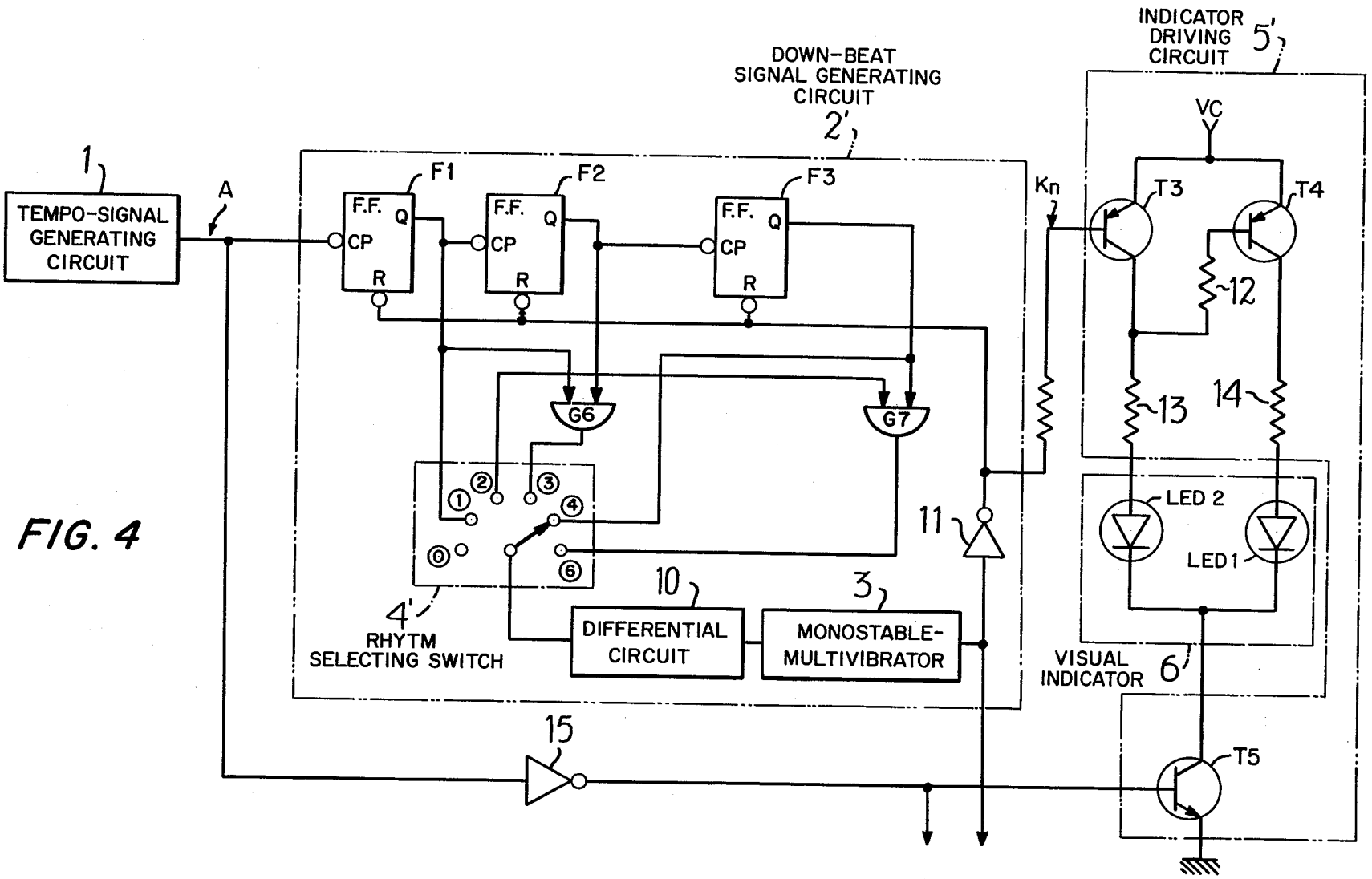
FIG. 4 is a circuit diagram of a second electronic metronome according to the invention.

FIG. 4 is a circuit diagram of another embodiment according to this invention, in which some reference numerals and marks refer as same as those in FIG. 1. NAND-gates $G_1$ and $G_2$ in FIG. 1 are respectively replaced by AND-gates $G_6$ and $G_7$. Reference numeral 4' designates a rhythm selecting switch, terminal ① of which is connected to output Q of flip-flop $F_1$ and terminal ④ is connected to output Q of flip-flop $F_3$ while other terminals ② and ③ have the same connection as those of switch 4 in FIG. 1, terminal ① being free. The signal fed through switch 4' is applied to a differential circuit 10 to be detected its rising up. The output of differential circuit 10 is then applied to monostable-multivibrator 3 which generates a some length pulse of level "1" in response to the output of differential circuit 10. This output pulse from monostable-multivibrator is fed to a conventional down-beat sound generator (not shown), with tempo signals, to generate rhythm sounds, and is further fed to an inverter 11 where the output signal of level "1" is inverted to that of level "0" to reset flip-flops $F_1$, $F_2$ and $F_3$.

Thus, down-beat signal generating circuit 2' operates as a divided by *n* counter ($n=1$, 2, 3, 4 and 6), giving output of level "1" to the down-beat sound generator and output of level "0" (Kn) to an indicator driving circuit 5'.

Indicator driving circuit 5' includes three transistor $T_3$, $T_4$ and $T_5$. The emitters of transistors $T_3$ and $T_4$ are connected in common to the power source VC. The base of transistor $T_3$ is connected to the output of inverter 11 to receive down-beat signal K*n* of level 0 while the base of transistor $T_4$ is connected with the collector of transistor $T_3$ by way of a resistor 12. The collectors of the transistors $T_3$ and $T_4$ are respectively connected to light emitting diodes $LED_2$ and $LED_1$ through resistor 13 and 14. The other terminals of the $LED_1$ and $LED_2$ are in common connected to the collector of transistor $T_5$ which emitter is connected to ground and which base is to receive inverted tempo signal through an inverter 15.

An inverted tempo signal of level 1 applied to the base of transistor 5 makes transistor 5 conductive allowing current to run through $LED_1$ and $LED_2$. At the same time, when a down-beat signal K*n* is applied to the base of transistor $T_3$, transistor $T_3$ is made conductive to allow current to run through resistor 13 and $LED_2$, which causes the potential on the base of transistor $T_4$ to rise up to high level so that transistor $T_4$ is made non-conductive. Thus down-beat signal K*n* makes $LED_2$ emit light for a down beat. In the absence of down-beat signal K*n*, a tempo signal A makes $LED_1$ emit different colour light for up beat as transistor $T_3$ is non-conductive and lower potential is applied on the base of transistor $T_4$ to make it conductive.

It is to be understood that the invention is not limited in the above embodiments. Two different colour light LEDS may be energized at the same time for a down-beat, effecting a mixed colour display, and three different colour light LEDS may be used for down-beat, up-beat and medial-beat.

What I claim is:

1. An electronic metronome comprising a tempo signal generating means having an output, a down-beat signal generating means connected with said output of said tempo signal generating means, said down-beat signal generating means receiving a tempo signal from said tempo signal generating means and generating a down-beat signal therefrom, an indicator driving circuit connected to said tempo signal generating means and to said down-beat signal generating means and receiving signals therefrom, said indicator driving circuit having first and second outputs, a first LED and a second LED connected respectively to said first and second outputs of said indicator driving circuit, said indicator driving circuit energizing said first LED to make it conduct when said indicator driving circuit receives only said tempo signal and energizing said second LED to make it conduct when said indicator driving circuit receives both said tempo signal and said down-beat signal, said first LED being different from said second LED in colour and being packaged close to said second LED.

2. An electronic metronome according to claim 1, in which said first LED and second LED are packaged together in a single envelope.

3. An electronic metronome according to claim 1, in which said down-beat signal generating means comprises counting means for producing a signal every *n* tempo signals and selecting switch means for selecting the value of *n*.

* * * * *